United States Patent [19]

McBarron

[11] Patent Number: 4,628,622

[45] Date of Patent: Dec. 16, 1986

[54] SHOE WITH FASTENABLE OPENING

[75] Inventor: George P. McBarron, Attleboro, Mass.

[73] Assignee: Stride Rite International, Inc., Cambridge, Mass.

[21] Appl. No.: 739,559

[22] Filed: May 30, 1985

Related U.S. Application Data

[63] Continuation of Ser. No. 499,992, Jun. 1, 1983, abandoned, which is a continuation-in-part of Ser. No. 415,573, Sep. 7, 1982, abandoned, which is a continuation-in-part of Ser. No. 357,413, Mar. 12, 1982, abandoned.

[51] Int. Cl.[4] ..... A43B 11/00; A43B 3/30

[52] U.S. Cl. ..... 36/50; 36/112; 2/DIG. 6

[58] Field of Search ..... 36/50, 51, 54, 112, 36/99, 83; 2/DIG. 6

[56] References Cited

U.S. PATENT DOCUMENTS

| | | | |
|---|---|---|---|
| 1,960,165 | 5/1934 | Ottinger | 36/50 |
| 2,012,188 | 8/1935 | French | 36/50 |
| 2,178,885 | 11/1939 | Buff et al. | |
| 2,330,224 | 9/1943 | L'Hollier | |
| 3,491,465 | 1/1970 | Martin | |
| 3,509,646 | 5/1970 | Vietas | |
| 3,618,235 | 11/1971 | Cary, Jr. | |
| 4,081,916 | 4/1978 | Salisbury | |
| 4,255,876 | 3/1983 | Johnson | 36/83 |
| 4,282,657 | 8/1981 | Antonious | |
| 4,384,414 | 5/1983 | Gamm | 36/132 |
| 4,414,761 | 11/1983 | Mahood | 36/50 |
| 4,451,995 | 6/1984 | Antonious | |

FOREIGN PATENT DOCUMENTS

| | | | |
|---|---|---|---|
| 475071 | 2/1951 | Canada | 36/50 |
| 1456085 | 9/1966 | France | 36/50 |
| 2271782 | 12/1975 | France | 36/50 |
| 2499375 | 8/1982 | France | 36/115 |
| WO81/01948 | 7/1981 | Int'l Pat. Institute | 36/112 |

*Primary Examiner*—James Kee Chi

[57] ABSTRACT

A child's lace shoe featuring, in one aspect, an upper having a rim, a pair of overlapping edge portions defining a fastenable opening extending from the rim in a forward and downward direction, and a pair of fastening elements affixed respectively to the overlapping edges and arranged to mate by pressing them together and to unmate by pulling them apart, so the shoe, after initial adjustment, can be put on and taken off without readjusting the laces.

12 Claims, 5 Drawing Figures

SHOE WITH FASTENABLE OPENING

BACKGROUND OF THE INVENTION

This application is a continuation of McBarron, Ser. No. 499,992, filed June 1, 1983, now abandoned, which is a continuation-in-part of McBarron, Ser. No. 415,573, filed Sept. 7, 1982, now abandoned, which is a continuation-in-part of McBarron, Ser. No. 357,413, filed Mar. 12, 1982, now abandoned all entitled "Shoe with Fastenable Opening".

This invention relates to children's lace shoes (e.g., sneakers).

Children often have difficulty lacing and unlacing their shoes and require assistance from an adult in putting them on and taking them off.

SUMMARY OF THE INVENTION

In general, the invention features, in one aspect, a child's lace shoe comprising an upper having a rim, a pair of overlapping edge portions defining a fastenable opening, the opening beginning at a point on the rim and extending forwardly and downwardly, and a pair of fastening elements affixed respectively to the overlapping edge portions; the fastening elements are arranged to mate when pressed together and to unmate when pulled apart and the edge portions are so arranged that the forces on the fastening elements, when mated, are predominantly in shear when the shoe is worn.

In preferred embodiments, the shoe has a u-throat eyestay or a lace-to-toe eyestay and the fastenable opening is positioned along the edge of the u-throat eyestay or the lace-to-toe eyestay and extends respectively to a point on the u-throat eyestay, which lies on the longitudinal centerline of the shoe, or to the forward end of the lace-to-toe eyestay; and each of the fastening elements, which are Velcro, has a main portion affixed to one of the overlapping edge portions, and a tail connected to the main portion and extending rearwardly along the rim; and the fastenable opening is located on the instep side of the shoe.

The shoe can be laced to the proper tension once by an adult and thereafter can be put on and taken off by the child opening and closing the fastening elements, without readjusting the laces.

In another aspect, the invention features a zipper including a pair of zipper elements affixed to the edge portions to permit closure of the opening.

In preferred embodiments, there is a flap affixed to one of the edge portions for covering at least a portion of the zipper when the zipper is closed; the flap is arranged to cover the zipper's closing and opening means and the rest of the zipper down to its bottom end; and the tongue is wide enough to extend beneath the zipper.

The tail of the fastening element helps to brace the fastenable opening against opening when the shoe is worn. The flap prevents the zipper from becoming unzipped, and, when the flap is long enough to extend to the bottom end of the zipper, hides it.

Other advantages and features of the invention will be apparent from the following description of the preferred embodiments thereof, and from the claims.

DESCRIPTION OF THE PREFERRED EMBODIMENTS

We turn now to the structure and operation of the preferred embodiments, first briefly describing the drawings thereof.

DRAWINGS

STRUCTURE

Figure 1:
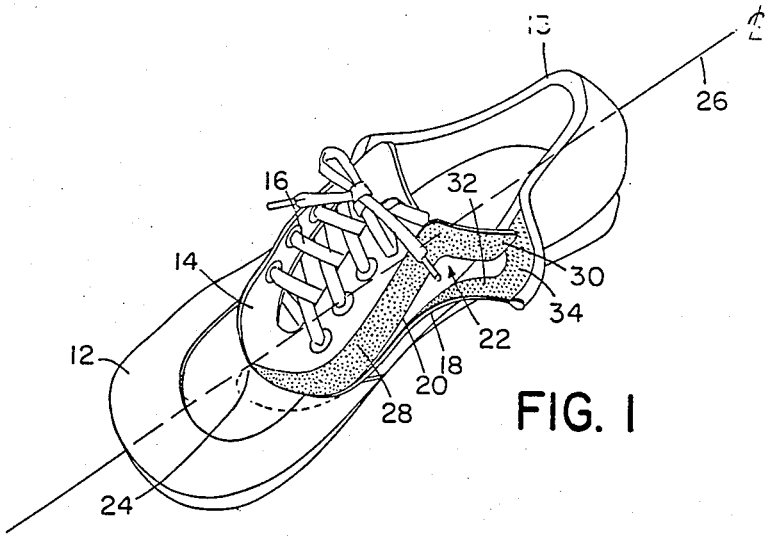
FIG. 1 is an isometric view of a child's sneaker.

Referring to FIG. 1, sneaker 10 has upper 12 having rim 13 and u-throat eyestay 14 for holding conventional laces 16; overlapping portions 18, 20 define fastenable opening 22 between u-throat eyestay 14 and upper 12 on the instep side of sneaker 10, extending from rim 13 down to a point 24 on the centerline 26 of sneaker 10.

Velcro strip 28 is sewn to the outside edge of u-throat eyestay 14 from point 24 to the top of u-throat eyestay 14, and has a tail 30 that extends from the top of u-throat eyestay 14 towards the rear of sneaker 10.

Velcro strip 32, including tail 34, is sewn to the inside edge of upper 12 and is positioned to mate with Velcro strip 28.

Figure 2:
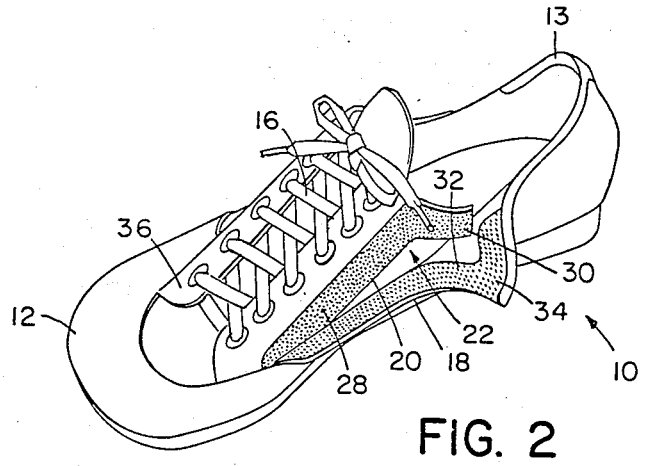
FIGS. 2 through 5 are isometric views illustrating four alternative embodiments of the invention.

Referring to FIG. 2, in another embodiment, sneaker 10 has lace-to-toe eyestay 36 and fastenable opening 22 extends to the forward end of eyestay 36.

Figure 3:
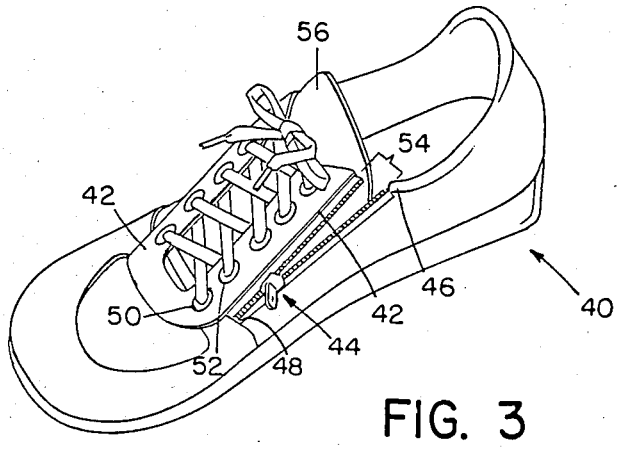

Referring to FIG. 3, in yet another embodiment, sneaker 40 has u-throat eyestay 42 and a zipper 44 running from rim 46 parallel to the eyestay, down to stop 48, adjacent to a point between the two lowest lace eyes 50 and 52. The zipper provides fastenable opening 54. Tongue 56 is wide enough to extend under opening 54, for protection of the foot.

Figure 4:
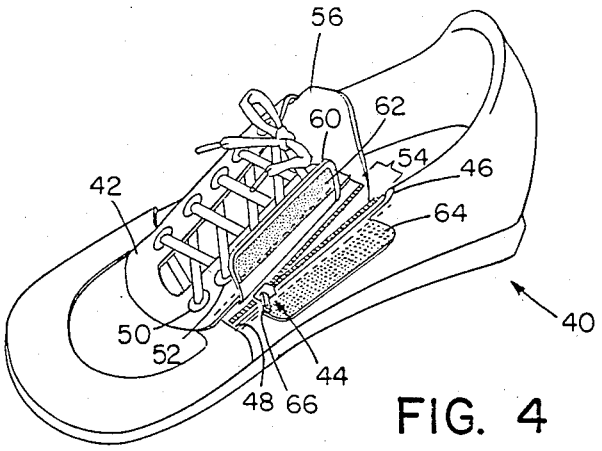

Referring to FIG. 4, in another embodiment, sneaker 40 has flap 60, one edge of which is sewn under the edge of eyestay 42. Velcro strips 62, 64 are respectively sewn on the underside of flap 60 and on the side of sneaker 40 adjacent zipper 44. Flap 60 extends from the lower end of zipper 44 up to the point where zipper pull 66 (the zipper's opening and closing means) is positioned when zipper 44 is zipped.

Figure 5:
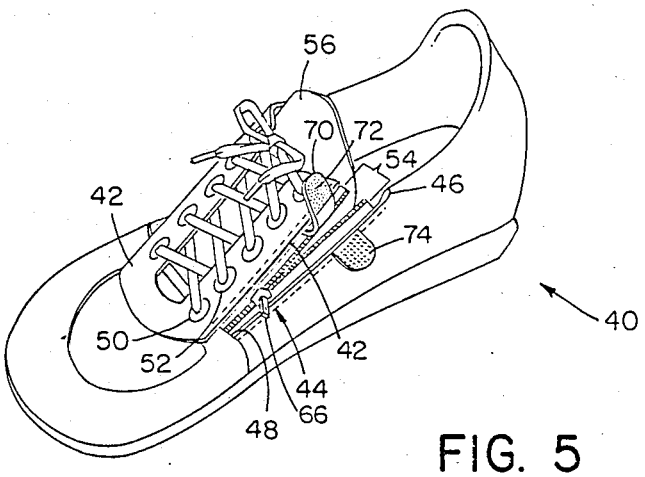

Referring to FIG. 5, in another embodiment, flap 70 is positioned at the location where zipper pull 66 is located when zipper 44 is zipped. Velcro strips 72, 74 are sewn respectively to the underside of flap 70 and to the side of sneaker 40 opposite flap 70.

OPERATION

An adult initially adjusts laces 16 to insure a proper fit of sneaker 10 on the child's foot. Sneaker 10 can then be removed by the child peeling apart Velcro strips 28, 32 and be put on the child, without readjusting the laces, by pressing together Velcro strips 28, 32.

When mated, Velcro strips 28, 32 resist the predominantly shear forces caused in wearing the shoe.

Zipper 44 also permits removal and putting on of the sneaker without readjusting the laces.

Flaps 60, 70 are fastened (by mating Velcro strips 62, 64 and 72, 74) to hide zipper 44 and (by holding pull 66 down) to prevent zipper 44 from becoming unzipped.

OTHER EMBODIMENTS

Other embodiments are within the following claims. E.g., the fastenable openings can be on the outside portion of the upper instead of the instep side, or even on both sides.

I claim:

1. A child's lace shoe comprising an upper having:

a rim, an eyestay, a pair of edge portions defining a fastenable opening, said opening beginning at a point on said rim and extending forwardly and downwardly along said eyestay to a stop, the extent of said opening being sufficient so that, after adjustment, said shoe can be put on and taken off without readjusting the laces of said shoe, a zipper including a pair of zipper elements affixed respectively to said edge portions to permit closure of said opening, a fastenable covering element for covering at least a portion of said zipper when said zipper is closed, and a tonque wide enough to extend beneath said zipper.

2. The shoe of claim 1 wherein said covering element comprises a flap affixed to one of said edge portions.

3. The shoe of claim 1 wherein said zipper comprises means for closing and opening said zipper, and said covering element is arranged to cover said closing and opening means when said zipper is closed.

4. The shoe of claim 3 wherein said covering element covers said zipper from its bottom end to the location of said closing and opening means when said zipper is closed.

5. A child's lace shoe comprising an upper having a rim, a pair of overlapping edge portions defining a fastenable opening, said opening beginning at a point on said rim and extending forwardly and downwardly, the extent of said opening being sufficient so that, after adjustment, said shoe can be put on and taken off without readjusting the laces of said shoe, and a pair of fastening elements affixed respectively to said overlapping edge portions, said fastening elements being arranged to mate at a plurality of points along said fastenable opening when pressed together and to unmate when pulled apart, said edge portions being so arranged that the forces on said fastening elements, when mated, are predominantly in shear, when said shoe is worn, each of said fastening elements comprising a main portion affixed to one of said overlapping edge portions, and a tail extending rearwardly along said rim, said main portion being elongated in a direction generally parallel to the edge of said fastenable opening, said tail extending in a direction transverse to the direction of said main portion.

6. The shoe of claim 5 wherein said tail is connected to said main portion.

7. The shoe of claim 5 wherein said upper further comprises an eyestay and said fastenable opening lies along said eyestay, one said fastening element being affixed to said eyestay, the other said fastening element being affixed to said upper.

8. The shoe of claim 5 wherein said fastening elements are hook-and-loop material.

9. The shoe of claim 5 wherein said fastenable opening is located on the instep side of said shoe.

10. A child's lace shoe comprising an upper having:

a rim, a pair of overlapping edge portions defining a fastenable opening, said opening beginning at a point on said rim and extending forwardly and downwardly, the extent of said opening being sufficient so that, after adjustment, said shoe can be put on and taken off without readjusting the laces of said shoe, and a pair of fastening elements affixed respectively to said overlapping edge portions, said fastening elements being arranged to mate at a plurality of points along said fastenable opening when pressed together and to unmate when pulled apart, said edge portions being so arranged that the forces on said fastening elements, when mated, are predominantly in shear, when said shoe is worn, said upper further comprising an eyestay, said fastenable opening lying along said eyestay, one said fastening element being affixed to an outer surface of said eyestay, and another said fastening element being affixed to an inner surface of said upper.

11. The shoe of claim 7 or 10 wherein said eyestay is a u-throat eyestay, and said fastenable opening extends to a point on said u-throat eyestay lying on the longitudinal center line of said shoe.

12. The show of claim 7 or 10 wherein said eyestay is a lace-to-toe eyestay.

* * * * *